US006806098B2

(12) United States Patent
Ohtake et al.

(10) Patent No.: US 6,806,098 B2
(45) Date of Patent: Oct. 19, 2004

(54) METHOD AND DEVICE FOR ASSESSING SURFACE UNIFORMITY OF SEMICONDUCTOR DEVICE TREATED BY CMP

(75) Inventors: Atsushi Ohtake, Hitachi (JP); Kinya Kobayashi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 40 days.

(21) Appl. No.: 10/321,603

(22) Filed: Dec. 18, 2002

(65) Prior Publication Data

US 2003/0207576 A1 Nov. 6, 2003

(30) Foreign Application Priority Data

May 1, 2002 (JP) ..... 2002-129801

(51) Int. Cl.[7] ..... H01L 21/00

(52) U.S. Cl. ..... 438/5; 702/167; 451/5

(58) Field of Search ..... 438/5, 8, 14, 16, 438/689–693, 6; 451/5, 6, 1; 702/85, 98, 167; 700/121; 216/38

(56) References Cited

U.S. PATENT DOCUMENTS 5,552,996 A * 9/1996 Hoffman et al. ..... 700/121
6,484,300 B1 * 11/2002 Kim et al. ..... 716/7

FOREIGN PATENT DOCUMENTS

| | | |
|---|---|---|
| JP | 05-251524 | 9/1993 |
| JP | 11-186205 | 7/1999 |
| JP | P2000-306871 A | 11/2000 |
| JP | P2000-332073 A | 11/2000 |
| JP | P2001-21317 A | 1/2001 |

OTHER PUBLICATIONS

N.S. Patel et al., "In Situ Estimation of Blanket Polish Rates and Wafer–to–Wafer Variation," 2002, IEEE Transactions on Semiconductor Manufacturing, vol. 15, No. 4, pp. 513–522.*

J. Luo et al., "Material Removal Mechanism in Chemical Mechanical Polishing: Theory and Modeling," 2001, IEEE Transactions on Semiconductor Manufacturing, vol. 14, No. 2, pp. 112–133.*

K. Ryu et al., "An Analytical Model of Multilevel ILD Thickness Variation Induced by the Interaction of Layout Pattern and CMP Process," 1999 IEEE International Symposium on Semiconductor Manufacturing, pp. 221–224.*

O.S. Nakagawa et al., Modeling of Pattern–Dependent On–chip Interconnect Geometry Variation for Deep–Submicron Process and Design Technology, 1997, IEDM, pp. 6.4.1–6.4.4.*

T. Ohta et al., "A Practical CMP Profile for LSI Design Application," 1999 International Conference on Simulation of Semiconductor Processes and Devices ISPAD '99, pp. 195–198.*

A.L. Swecker et al., Evaluation of Defect Detection Schemes for CMP Process Monitoring Using Rigorous #–D EM Simulations 1997, IEEE/SEMI Advanced Semiconductor MAnufacturing Conference, pp. 283–288.*

Y.H. Kim et al., "CMP Profile Simulation Using An Elastic Model Based on Nonlinear Contact Analysis," 1997 IEEE, International Conference on Simulation of Semiconductor Processes and Devcies SISPAD '97, pp. 69–72.*

(List continued on next page.)

*Primary Examiner*—Evan Pert
(74) *Attorney, Agent, or Firm*—McDermott Will & Emery LLP

(57) ABSTRACT

This invention provides an inspection method and device which can efficiently measure the surface uniformity of a semiconductor device which is chemically and mechanically polished based on measured data at several points on the surface of the chip.

20 Claims, 5 Drawing Sheets

OTHER PUBLICATIONS

T.L. Tung, "A Method for Die–Scale Simulation of CMP Planarization," 1997 IEEE,International Conference on Simulation of Semiconductor Processes and Devices SISPAD '97, pp. 65–68.*

D.S. Boning et al., "Run by Run Control of Chemical–Mechanical Polishing," 1996 IEEE Transactions on Componenets, PAckaging, and Manufacturing technology, PArt C, pp. 307–314.*

T.K. Yu, "A Statistical Polishing Pad Model For Chemical–Mechanical Polishing," 1993 IEEE Electron Devices Meeting, Technical Digest International, pp. 865–868.*

DOI "Details of Semiconductor CMP Technology" (2000) pp. 162–171, 362–363. (w/English translation).

* cited by examiner

PROJECTING REGION INDICATED BY WHITE PORTION AND RECESSED REGION INDICATED BY BLACK PORTION

PROJECTING PORTION ENLARGED BY DEPOSITION OF OZONE-TEOS OXIDE FILM

METHOD AND DEVICE FOR ASSESSING SURFACE UNIFORMITY OF SEMICONDUCTOR DEVICE TREATED BY CMP

BACKGROUND OF THE INVENTION

1. Field of the Invention

The present invention relates to a method and device for inspecting a surface of a semiconductor device, and more particularly to a method which can efficiently inspect a surface uniformity of a semiconductor which is treated by a chemical mechanical polishing method.

2. Description of the Related Art

As a process for leveling or flattening a semiconductor device, a chemical mechanical polishing method (CMP method) has been popularly used. The CMP process is a process which flattens the semiconductor device by polishing irregularities formed on a surface of an oxide film or a metal film formed on a semiconductor device.

Steps having a maximum height of several 100 nm before performing are reduced to several 10 nm after the CMP treatment. To check an effect of leveling by the CMP process, various surface measuring methods and simulation methods have been adopted.

(1) Japanese Laid-open Patent Publication 306871/2000, Japanese Laid-open Patent Publication 186205/1999 and the like disclose a method for predicting the height after CMP polishing based on simulations.

(2) Japanese Laid-open Patent Publication 21317/2001 discloses means for inspecting a surface height deviation after CMP polishing using an optical measurement.

(3) Japanese Laid-open Patent Publication 332073/2000 discloses a method and device for inspecting a semiconductor substrate.

(4) Japanese Laid-open Patent Publication 251524/1993 discloses a method which determines a measuring position of a contact type measuring device using mask data.

SUMMARY OF INVENTION

The method which predicts irregularities after CMP polishing based on simulations is disclosed in many other literatures besides the above-mentioned known example (1) and the progress of the study on polishing of an oxide film using CMP has been particularly noticeable. However, when the surface uniformity of a semiconductor device is predicted based on only the simulations, since parameters of the simulations are fluctuated in response to delicate changes of the process, it is not always possible to obtain the surface height deviation with an accuracy which falls in a range of several nm to several tens nm.

The above-mentioned known example (2) evaluates irregularities after CMP polishing by the measurement. To perform the evaluation of irregularities after CMP polishing, positional resolution of $\mu$m order and the height resolution of nm order are necessary and hence, it takes several ten minutes to several hours to evaluate the whole semiconductor device, that is, the whole semiconductor chip or the whole wafer. Accordingly, the inspection of the whole wafer to be polished remarkably deteriorates the throughput and hence, it is difficult to exercise the known example (2).

The inspection method of the semiconductor substrate disclosed in the above-mentioned known example (3) also requires a long measuring time and hence, it is difficult to apply this method to the detailed inspection of all wafers.

The above-mentioned known example (4) also has the same problems.

Accordingly, it is an advantage of the present invention to provide a method and device for inspecting a surface of a semiconductor device provided with means which can efficiently measure the surface uniformity of a polished semiconductor device based on measured data at several points within the chip surface.

To achieve the above-mentioned advantage, the present invention proposes a method for inspecting a surface of a semiconductor device being characterized in that exposure mask data for a semiconductor device is divided into arbitrary regions, in an arbitrary region j of the exposure mask data, $\rho j = Pj/Sj$ which is a ratio between an area Sj of the region j and an area Pj of a portion in the region j where a pattern is present is calculated, a surface height deviation Hj of the semiconductor after chemical mechanical polishing is obtained by a simulation which is performed using, as parameters, the ratio $\rho j$, a size h of a step on a surface of the semiconductor device before polishing, a polishing speed K of a chemical mechanical polishing device, Young's modulus G of a polishing pad, a half-value width Rc of a stress function and a thickness d of the polishing pad, surface height deviations Hej are measured at at least two divided regions, the surface height deviation Hj after the chemical and mechanical polishing and the measured surface height deviations Hej are compared with each other, values of the polishing speed K, the Young's modulus and the half-value width Rc are changed until the surface height deviation Hj after chemical and mechanical polishing agrees with the measured surface height deviations Hej at least in portions of the regions, and surface height deviations after polishing are simulated using values of the polishing speed K, the Young's modulus G, the half-value width Rc and the thickness d which are newly obtained by the change and surface height deviations of regions where the above-mentioned measured surface height deviations Hej are not present are determined.

According to this invention, it is possible to know the surface height deviation distribution of the whole region of a semiconductor chip or a semiconductor wafer by measuring only extremely partial regions thereof and hence, the measuring time can be largely reduced.

In one aspect of the invention, when an object to be polished is a silicon oxide film or a silicon oxide film containing at least one kind selected from a group consisting of hydrogen, carbon, phosphorus and fluorine, a value of 0.5 mm to 2.0 mm is used as a value of the half-value width Rc of the stress function, and as a value $K \times G/(P \times d)$ which is obtained by dividing a value of $K \times G$ with a pressure P with which the polishing pad comes into contact with the surface of the semiconductor device and a thickness d of the polishing pad, a value which falls in a range from 0.016 to 0.05 is used.

According to this aspect of the invention, it is possible to shorten the time from the measurement to the determination of the surface height deviation distribution while maintaining the inspection accuracy (accuracy with respect to position and height).

In another aspect of the invention, the values of the polishing speed K, the Young's modulus G and the half-value width Rc which minimize an error evaluation function $\Sigma j(Hj-Hej)^2$ can be obtained by a least square method, and a surface height deviation after the chemical mechanical polishing at an arbitrary point on a semiconductor chip or a wafer can be obtained based on the value of the thickness d and the values of the polishing speed K, the Young's modulus G and the half-value width Rc which are obtained by the least square method.

According to this aspect of the invention, the surface height deviation distribution after polishing can be predicted in a shorter time.

In a still another aspect of the invention, a lowest point and a highest point in a surface height deviation before the chemical and mechanical polishing can be calculated to select as regions which constitute the objects to be measured of the surface height deviation Hej.

According to this aspect of the invention, a range of the surface height deviation distribution on the chip or the wafer can be obtained with an improved accuracy.

In a still another aspect of the invention, the exposure mask data can include exposure mask data of at least one layer which is present below a layer which constitutes an object to be polished.

According to this aspect of the invention, the prediction of the surface height deviation distribution can be made while taking the influence of irregularities of the lower layer into account and hence, high surface height deviation prediction accuracy is ensured even in case of a multi-layered film.

In a still another aspect of the present invention, the divided regions are, to be more specific, formed in square having a length of each side of 0.5 $\mu$m to 250 $\mu$m.

According to this aspect of the invention, it is possible to obtain the surface height deviation distribution without performing an unnecessarily large number of calculations.

In a still another aspect of the invention, a film which constitutes an object to be polished may be an ozone-TEOS (Tetraethylorthosilicate) film, a plasma TEOS film, a high-density plasma CVD film, a spin coat insulation film, a silicon nitride film, a plated Cu film, a tungsten film, a tantalum film, a ruthenium film, a titanium nitride film or a combination of these films.

According to this aspect of the invention, it is possible to perform the surface height deviation inspection of the surface of semiconductor device in which various films are formed as a single layer or as laminated layers.

In a still another aspect of the invention, the surface height deviation measuring method is any one of a tracing method, an optical measuring method, an electric resistance measuring method and a scanning electron microscope or a combination of these methods.

According to this aspect of the invention, the optimum measuring method can be selected depending on the semiconductor wafer or the semiconductor chip.

The present invention also proposes a device for inspecting a surface of a semiconductor device which comprises means which divides exposure mask data for a semiconductor device into arbitrary regions and calculates, in an arbitrary region j of the exposure mask data, $\rho j = Pj/Sj$ which is a ratio between an area Sj of the region j and an area Pj of a portion in the region j where a pattern is present, means which obtains a surface height deviation Hj of the semiconductor device after chemical mechanical polishing by a simulation which is performed using, as parameters, the ratio $\rho j$, a size h of a step on a surface of the semiconductor device before polishing, a polishing speed K of a chemical mechanical polishing device, Young's modulus G of a polishing pad, a half-value width Rc of a stress function and a thickness d of the polishing pad, means which measures the surface height deviation Hej at at least two divided regions, means which compares the surface height deviation Hj after the chemical and mechanical polishing and the measured surface height deviations Hej each other, means which changes the values of the polishing speed K, the Young's modulus and the half-value width Rc until the surface height deviation Hj after chemical and mechanical polishing agrees with the measured surface height deviations Hej at least in a portion of the region, and means which simulates surface height deviations after polishing using values of the polishing speed K, the Young's modulus G, the half-value width Rc and the thickness which are newly obtained by the change and determines surface height deviations of regions where the surface height deviation Hej are not present According to the invention, it is possible to know the surface height deviation distribution of the whole region of a semiconductor chip or a semiconductor wafer by measuring only extremely partial regions thereof using the surface height deviation measuring means and hence, the measuring time can be largely reduced. Further, the obtained measured result is equivalent to that of a surface measuring device which uses with respect to the surface height deviation accuracy and the positional accuracy.

In one aspect of the invention, the surface height deviation measuring means is surface height deviation measuring means including at least one of a tracing method, an optical measuring method, an electric resistance measuring method and a scanning electron microscope.

According to this aspect of the invention, it is possible to select the optimum surface height deviation measuring means depending on the semiconductor wafer or the semiconductor chip.

DESCRIPTION OF THE PREFERRED EMBODIMENTS

A method for inspecting a surface of a semiconductor device according to the present invention is explained in conjunction with FIG. 1 to FIG. 9.

(Embodiment 1)

In this embodiment 1, a fundamental formula used for simulations is a formula described in "Handoutai CMP Gijutsu (Semiconductor CMP Technique)" edited and written by Toshiro Doi, from page 162 or "A closed-form analytic model for ILD thickness variation in CMP process" written by B. Stine et al., Prc. CMP-MIC, Santa Clara (February 1997) or modifications thereof.

With respect to the simulation method on oxide films, there have been proposed a large number of theoretical formulae up to now. This embodiment 1 adopts a simulation which uses at least mask data of a semiconductor device (data of GDSII format), the size "h" of steps on a surface of the semiconductor device, and a wafer polishing speed K at pattern density of 100% of a chemical mechanical polishing device as input information.

Figure 1:
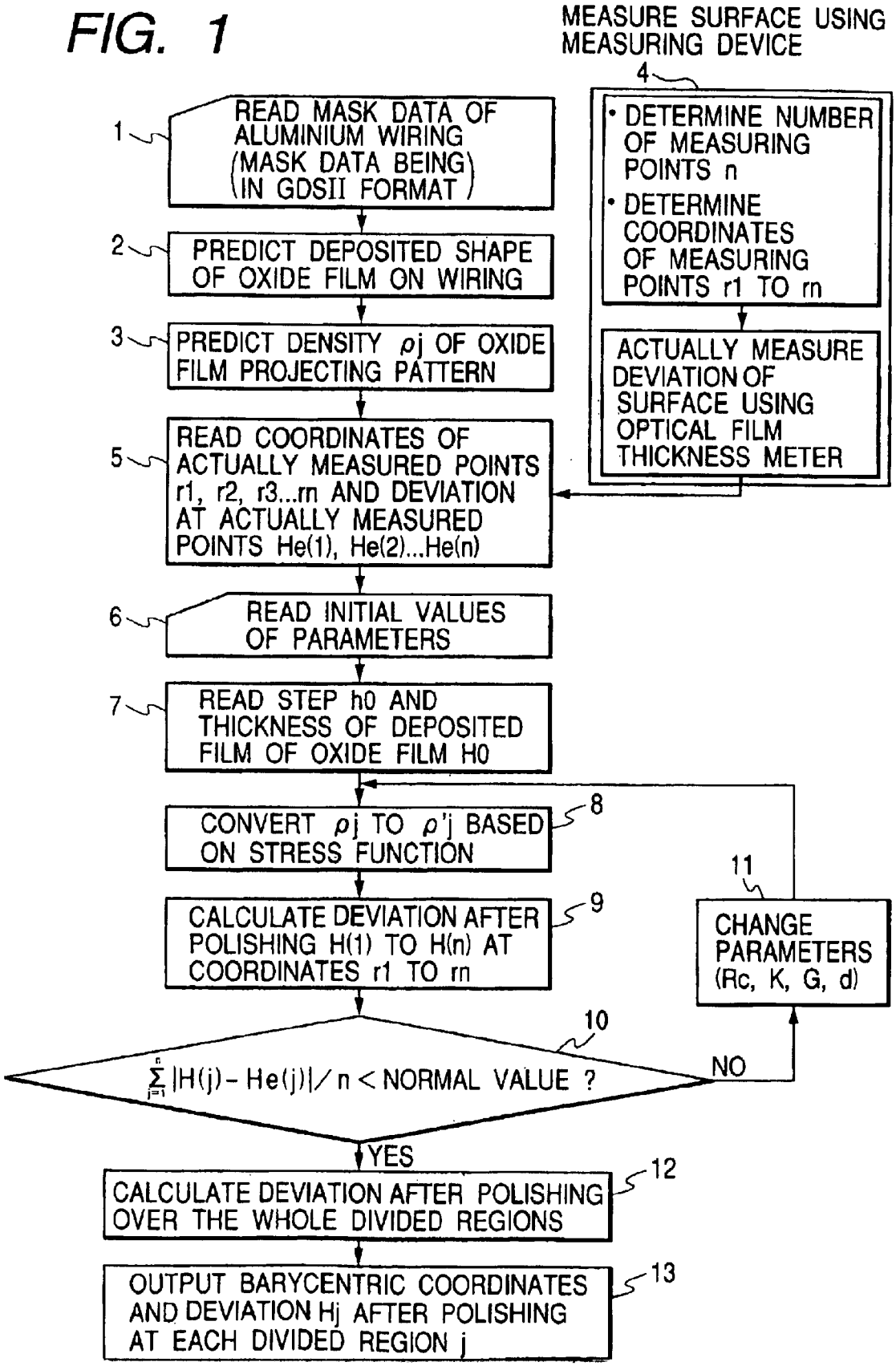
FIG. 1 is a flowchart showing processing procedure of a method for inspecting a surface of a semiconductor device after a CMP polishing according to the present invention.

FIG. 1 is a flowchart showing processing steps of a method for inspecting a surface of a semiconductor device after the CMP polishing according to the present invention. An object to be polished is an ozone-TEOS oxide film which is formed on aluminum wiring. The semiconductor device is a test chip of 10 mm square.

In step 1, mask data of the aluminum wiring is read. The mask data is formed using a GDSII format. With the use of the mask data of the GDSII format, it is possible to determine the positional coordinates of the aluminum wiring on the chip with the positional accuracy of 1 to 10 nm.

In step 2, the shape of the oxide film deposition on the aluminum wiring is predicted. Since the object to be polished is not the aluminum wiring but the ozone-TEOS film, the prediction of the deposition shape is necessary.

Figure 2:
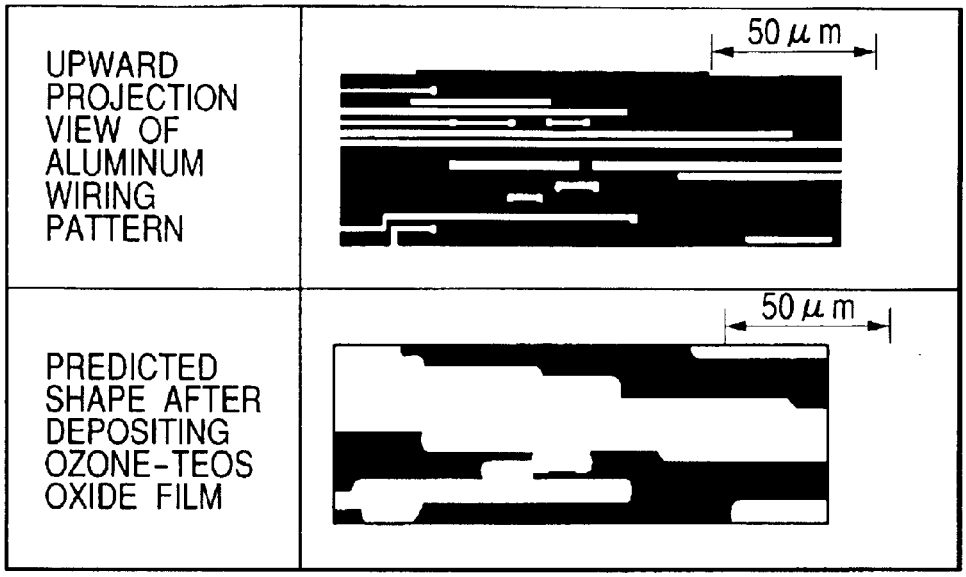
FIG. 2 is a plan view of a projecting pattern after formation of aluminum wiring pattern and deposition of an ozone-TEOS oxide film.

FIG. 2 is a plan view of a projecting pattern after the formation of aluminum wiring pattern and the deposition of ozone-TEOS oxide film. White portions shown in FIG. 2 are portions which are projected and black portions are portions which are indented or recessed.

When the ozone-TEOS oxide film is deposited on the aluminum wiring, the regions having a projecting shape (white portions in FIG. 2) are enlarged than the aluminum wiring per se. The method for obtaining this enlarged region is well known and is described in detail in Japanese Laid-open Patent Publication 186205/1999, for example.

In step 3, the area ratio ρj that the projecting regions occupy in each region in the inside of the chip after the ozone-TEOS oxide film is deposited is obtained.

Figure 3:
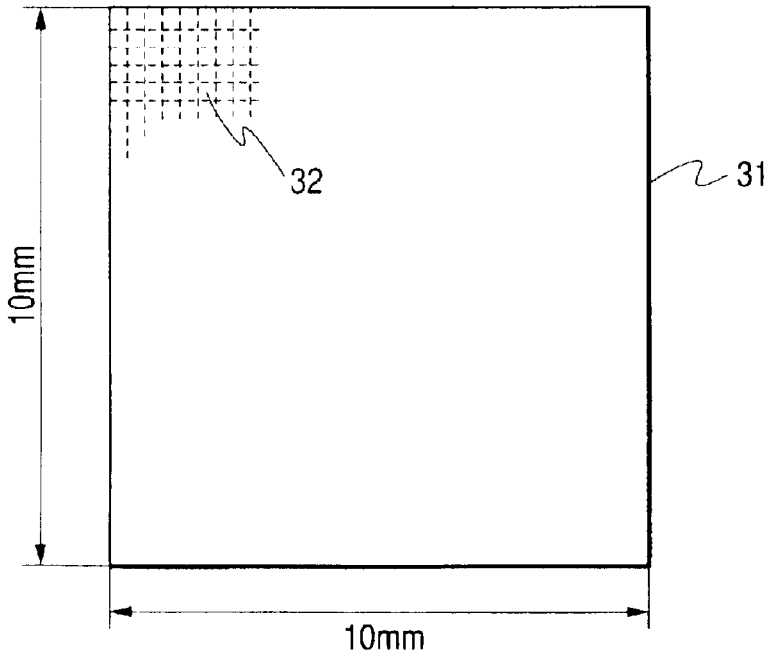
FIG. 3 is a plan view showing an example of a method for dividing a region of a semiconductor chip.

FIG. 3 is a plan view showing an example of a method for dividing the region of the semiconductor chip. As shown in FIG. 3, the chip 31 of 10 mm square is divided into regions 32 each being of 100 μm square. The chip 31 is divided into 10000 regions in total. Numbers (j) from 1 to 10000 are given to respective small regions and barycentric coordinates of the divided regions are stored. Further, the rates which the projecting patterns occupy respective divided regions 32 are calculated and stored as ρj.

In step 4, the coordinates r1, r2, r3 . . . rn of measuring points of the chip and surface height deviation values He(1), He(2), He(3) . . . He(n) at these measuring points are read.

In step 5, the coordinates of the measuring points and the number n of the measuring points are determined at a stage before the measurement. In this embodiment 1, the number n of measuring points is set to n=4. In determining the coordinates of the measuring points, they are aligned with the barycoordinates j of the divided regions in the simulation. The coordinates r1 to rn of the measuring points are determined. In this embodiment 1, the surface height deviations He(1) to He(n) at the measuring points 1 to n are actually measured using an optical film thickness meter.

In step 6, initial values of parameters are read. The details of parameters are explained later.

In step 7, the deposition film thickness H0 of the oxide film with a step h0 is read.

In step 8, the ρj values of the function F are converted into average pattern density p'j.

Assuming the barycoordinates of the divided region of number j as rj, the average pattern density p'j is expressed by a following formula.

$$\rho' j = \sum r'\{F(rj+r', Rc)(\rho j(rj+r'))\} \Big/ \sum r'\{F(Rc, rj+r')\}$$

Here, F(r, Rc) may be a Gaussian function, the quadratic function, the exponential function or the like. In this embodiment, the Gaussian function is adopted. Rc is a half-value width of the stress function F. Along with the increase of the half-value width Rc, the ratio ρj of the portion remote from the target position contributes to the polishing speed. When the oxide film is subjected to CMP, this has the value of mm order. The initial value is set to 1.5 mm. r' is a value sufficiently larger than the half-value width Rc. Here, r' is 4 mm.

In step 9, using ρ'j obtained in step 8, the surface height deviation after polishing is obtained by following formulae.

At t<tc, $$Hj=H0-[tcK/\rho'j+K(t-tc)+(1-\rho'j)h1(1-\exp(-(t-tc)/\tau))]$$

At t≧tc $$Hj=H0-Kt/\rho'j \qquad (1)$$

Here,

[tc=ρ'j²ho/K h1=h0 (1-ρ'j)

1/τ=βVG/d (=KG/Pd)

β: Preston constant

V: contact speed

K: polishing speed when pattern density is 100%

G: Young's modulus of polishing pad

P: pressure applied to polishing pad d: thickness of polishing pad

H0: deposition thickness of oxide film

H0: step before polishing

The surface height deviation Hj assumes the height of an upper portion of aluminum wiring as an origin.

Figure 4:
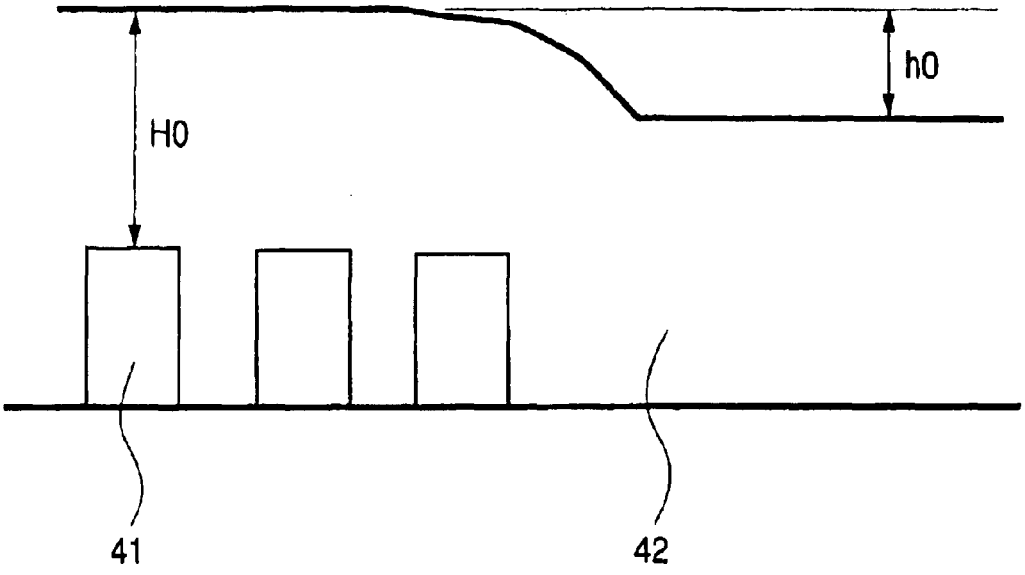
FIG. 4 is a cross-sectional view showing the structure of aluminum wiring 41 and an ozone-TEOS oxide film 42 deposited on the aluminum wiring 41.

FIG. 4 is a cross-sectional view showing aluminum wiring 41 and the structure of an ozone-TEOS oxide film 42 deposited on the aluminum wiring 41. As shown in FIG. 4, H0 indicates a thickness of the oxide film when an upper portion of the aluminum wiring is used as reference. In this embodiment 1, H0 is 1000 nm.

h0 indicates a step which is present on the oxide film. In this embodiment 1, the size of h0 is set substantially equal to the height of the aluminum wiring (500 nm).

Using the formula (1), the surface height deviations Hj at the coordinates where measuring points are scattered are calculated and stored.

In step 10, an error Cv between the simulated surface height deviation H(j) and the measured surface height deviation He(j) can be calculated using a following formula.

$$Cv = \sum_{j=1}^{n} |H(j) - He(j)| / n$$

When the error Cv is larger than a normal value (10 nm in this embodiment 1), the values of the polishing speed K, the Young's modulus G and the half value width Rc and the thickness d which constitute the parameters are changed in step 11 and then the simulation starting from step 8 is repeated.

The parameters are sequentially changed using a trial-and-error method. In this embodiment 1, K and (1/τ) (=KG/Pd) are used as parameters. With respect to (1/τ) and K, a differential equation related to the parameters are available and they can be changed based on the least square method. In this embodiment 1, the error Cv is converged by performing trials five times. As the result, Rc=1.50 [mm], 1/τ=0.004 [1/s] are obtained.

When the error Cv becomes equal to or below the normal value (10 nm in this embodiment 1), it is judged that the error Cv is converged and the Hj in the whole divided regions (j=1 to 10000) is calculated in step 12.

In step 13, the barycentric coordinates of the respective divided regions j and the surface height deviations Hj after polishing are outputted.

Figure 5:
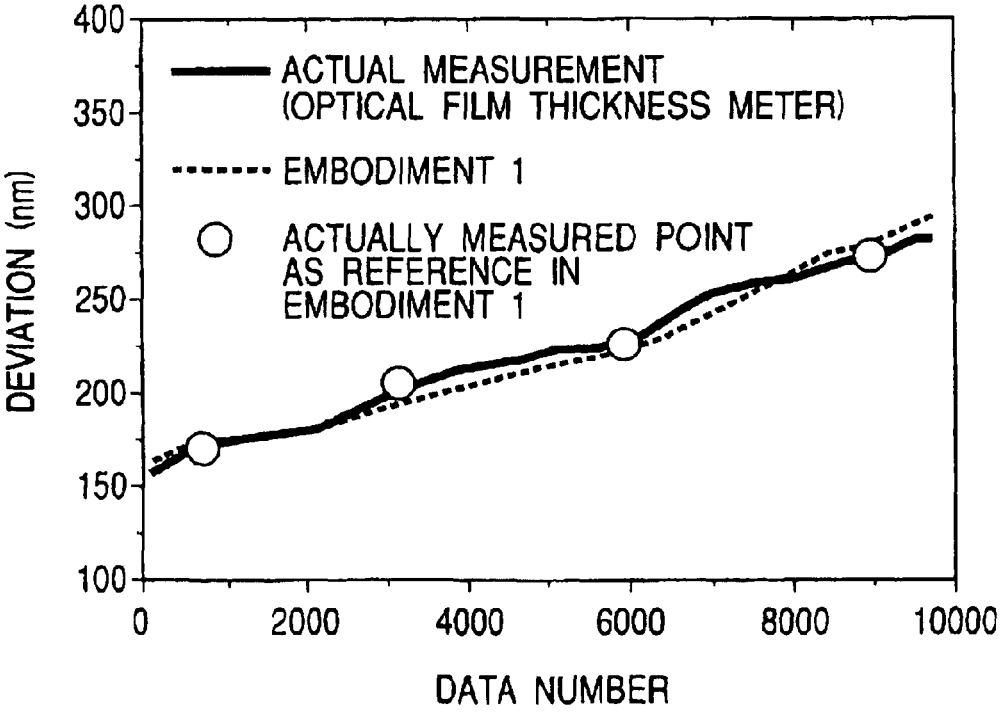
FIG. 5 is a graph showing a result obtained by measuring the whole chip region and the result which indicates the surface height deviation obtained by an embodiment 1 of the invention in comparison.

FIG. 5 is a view showing the result obtained by measuring all chip regions and the result when the surface height deviation is obtained by this embodiment 1 in comparison. In FIG. 5, the surface height deviations are plotted in the ascending order from the small surface height deviation. With respect to four measuring points, when the simulation is performed such that the measured result agrees with the result of the simulation within an error of 10 nm, it is understood that the whole surface height deviation distribution can be evaluated with an error of approximately 10 nm to 15 nm.

When the calculation is performed using an RISC work station, time required for measurement of four points is substantially approximately 10 seconds and time required for performing updating of parameters and simulation is approximately 50 seconds.

Time necessary for obtaining the same resolution, that is, time necessary for performing the measurement by dividing the inside of the chip into 10000 regions is equal or more than several hours.

According to this embodiment 1, the measuring points necessary for inspection can be reduced so that time necessary for determining the surface height deviation can be shortened to 1/100. Further, the device of this embodiment is equivalent to a measuring device which also adopts the general inspection accuracy.

[Embodiment 2]

In this embodiment 2, as explained in conjunction with the embodiment 1, as the parameter which is changed, 1/τ, that is, K×G/(P×D) is adopted. Here, an oxide film (silicon oxide film) which contains any one of hydrogen, carbon, phosphorus, fluorine constitutes an object to be polished.

With respect to such an oxide film, when 1/τ=0.016 to 0.05 [1/s] is used as an initial value, the number of trials can be reduced. Further, when Rc=0.5 mm to 2.0 mm is used as an initial value, the number of trials can be restricted within 10 times.

[Embodiment 3]

In the embodiment 1, it is also possible to obtain the same advantageous effect by using $Cv=(1/n)\Sigma j=\ln(Hj-Hej)^2$ as a function which evaluates the error between the result of measurement and the result of simulation and by determining the parameters Rc, K, G, d (or 1/τ) such that the error Cv is minimized using the least square method.

[Embodiment 4]

In the simulation according to the present invention, corresponding to the increase of the number of the divided regions, a calculation amount is increased proportionally. Usually, with respect to the CMP of the oxide film, the resolution of approximately several 10 μm to 100 μm is practically sufficient.

In the simulation performed in the embodiment 1, even when the resolution is set to 250 μm, the error in surface height deviation is within 18 nm.

On the other hand, even when a step for polishing a silicon nitride film is included, it has been found out that the resolution of approximately 0.5 μm at maximum is sufficient.

Accordingly, in this embodiment 4, assuming that each divided region has a square shape of 0.5 μm to 250 μm, the surface height deviation distribution can be accurately and rapidly predicted without requiring calculation exceeding a necessary amount.

[Embodiment 5]

Figure 6:
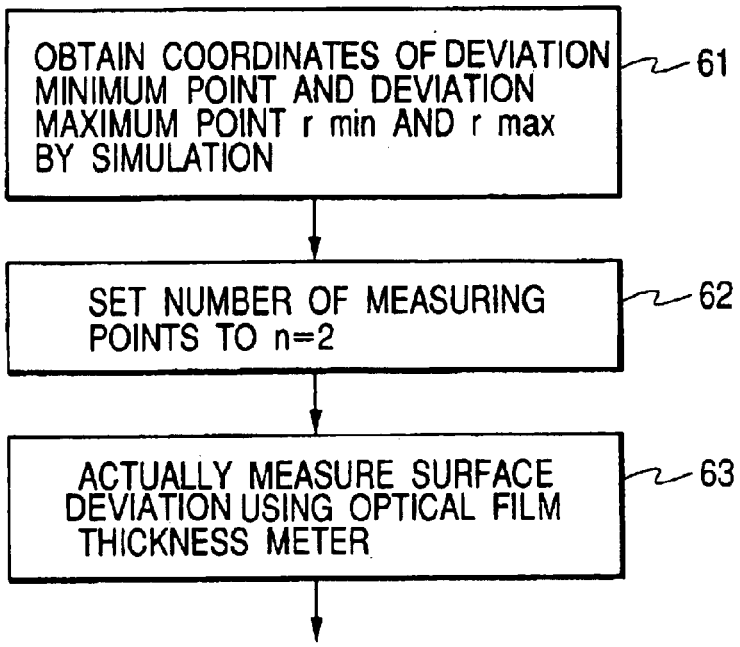
FIG. 6 is a flowchart showing processing procedure of an inspection method in which the coordinates of the maximum surface height deviation position and the minimum surface height deviation position in the inside of a chip or in the inside of a wafer are predicted before measurement by simulation and a plurality of measuring points including these two points are selected at the time of measurement.

FIG. 6 is a flow chart showing steps of processing of an inspection method in which coordinates of a highest surface height deviation position and a lowest surface height deviation position in the inside of the chip or in the wafer are predicted in advance by the simulation before the measurement and a plurality of measuring points including these 2 points are selected at the time of measurement.

In step 61, the coordinates r min of the minimum surface height deviation in the inside of the chip and the coordinates r max of the maximum surface height deviation in the inside of the chip are obtained by simulation in step 61.

In step 62, when it is desired to reduce the number of measuring points to the minimum number, only these two points are used.

In step 63, the surface height deviations after polishing at the coordinates of these two points are measured using an optical film thickness meter.

Using the result of measurement at these two points, the simulation parameters are determined in the same manner as the processing steps in the embodiment 1 and the surface height deviations after polishing of the whole chip area (10000 points in total) are determined.

As the result, the error generated between the determined surface height deviation and the measured result is within 15 nm in the whole region and this accuracy is almost equivalent to that of the embodiment 1 which uses the measured values at 4 points.

Since the embodiment 5 can substantially surely reproduce the surface height deviation points of the coordinates of the maximum surface height deviation and the coordinates of the minimum surface height deviation in the inside of the chip, the embodiment 5 is suitable for setting a range of surface height deviation in the chip.

According to this embodiment 5, it is possible to grasp the range of the surface height deviation distribution after polishing with improved accuracy and in a short time.

[Embodiment 6]

This embodiment 6 uses at least a portion of exposure mask data which is present below a layer constituting an object to be polished as the exposure mask data.

Figure 7:
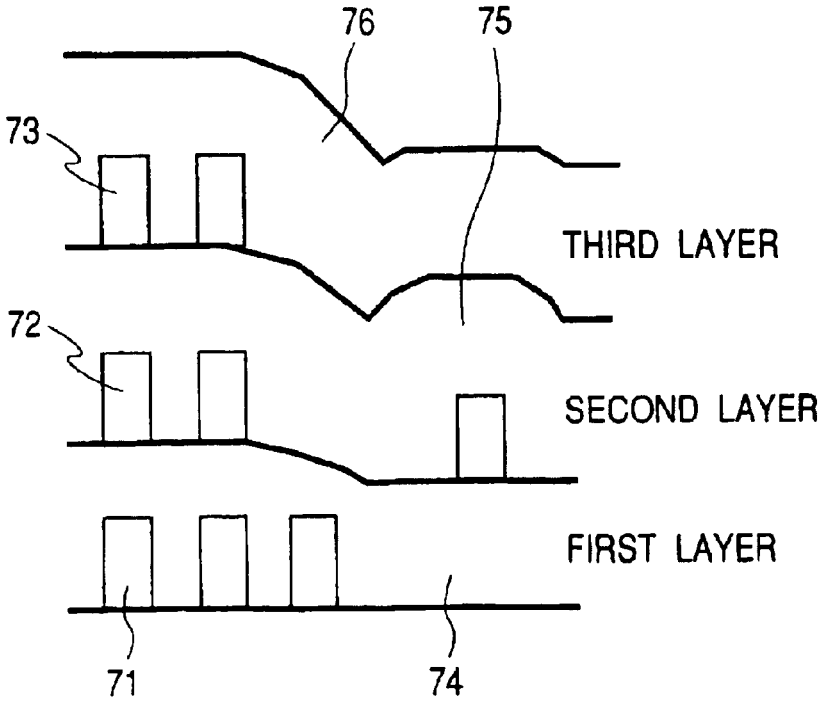
FIG. 7 is a view showing the schematic structure of a cross-section of a testing semiconductor chip which is formed by laminating a multi-layered ozone-TEOS oxide film.

FIG. 7 is a view showing a schematic structure of a cross section of a semiconductor chip for test on which a plurality of ozone-TEOS oxide films are laminated.

In a semiconductor chip for test shown in FIG. 7, alumina wiring patterns 71 to 73 in three layers are present. Corresponding to these alumina wiring patterns 71 to 73, ozone-TEOS oxide films 74 to 76 in three layers are laminated.

The film which constitutes an object to be polished in the embodiment 6 is an ozone-TEOS oxide film 76. The ozone-TEOS oxide film 76 receives an influence of irregularities of the ozone-TEOS oxide films 74, 75 which are arranged below the ozone-TEOS oxide film 76 and are not subjected to the CMP treatment.

In such laminated films, even when the processing steps shown in FIG. 1 are executed taking only the aluminum wiring pattern 73 into consideration, it is expected that the result with favorable accuracy cannot be obtained.

Accordingly, the inventors have tried whether the surface height deviation distribution after polishing of high accuracy can be obtained or not by inserting the distribution of steps which are generated in the ozone-TEOS oxide films 74, 75 into the steps h0 before polishing.

Figure 8:
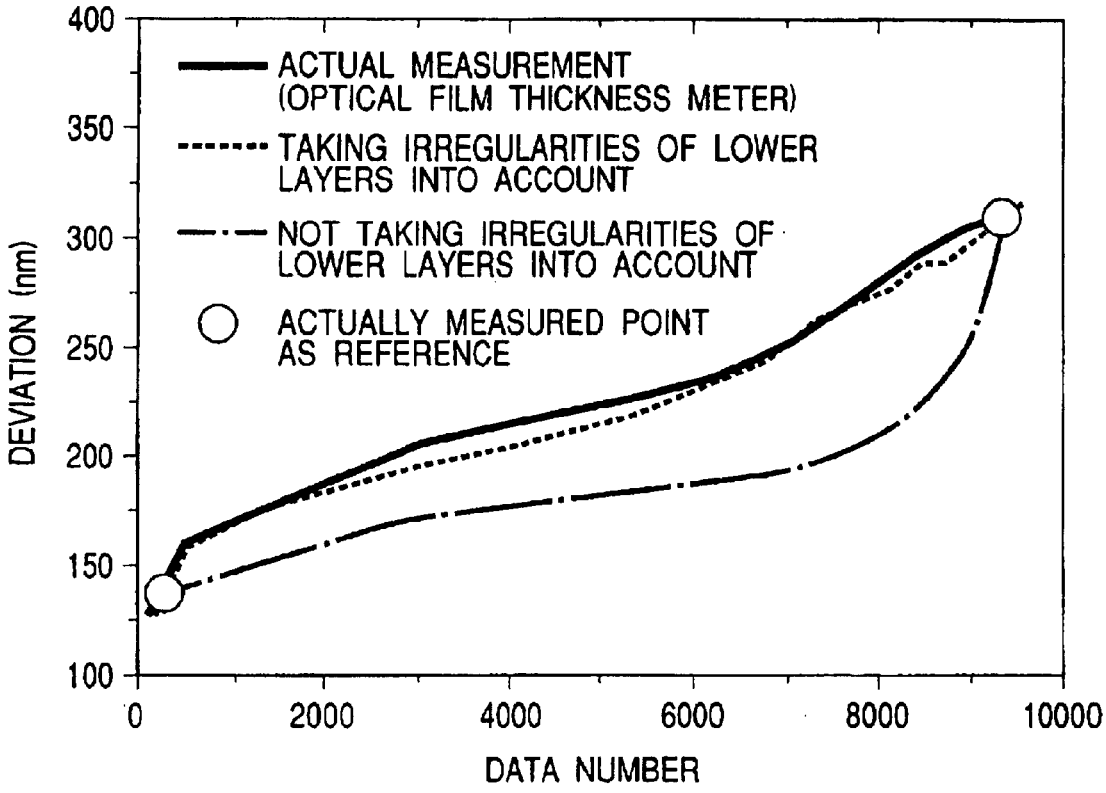
FIG. 8 is a view showing an example of the surface height deviation distribution of a semiconductor chip for test which is formed by laminating a multi-layered ozone-TEOS oxide film.

FIG. 8 is a view showing one example of the surface height deviation distribution of the semiconductor chip for test which is formed by laminating a plurality of ozone-TEOS oxide films.

It has been found that when the irregularities of lower layers are not taken into consideration, the error of several 10 nm is generated except for the vicinity of the measuring points of the maximum and minimum surface height deviations, while when the irregularities of lower layers are taken into consideration, the result of measurement can be reproduced with the error of approximately 10 nm over the whole regions (10000 points within chip).

According to this embodiment 6, even in the semiconductor device adopting the multi-layered films, it is possible to ensure the high surface height deviation prediction accuracy with respect to the surface of the semiconductor device.

[Embodiment 7]

In the above-mentioned respective embodiments, even when the object to be polished is a metal thin film, the similar advantageous effects can be obtained. The film which constitutes an object to be polished may be an ozone-TEOS (Tetraethylorthosilicate) film, a plasma TEOS film, a high-density plasma CVD film, a spin coat insulation film, a silicon nitride film, a plated Cu film, a tungsten film, a tantalum film, a ruthenium film, a titanium nitride film or a combination of these films.

[Embodiment 8]

In the above-mentioned respective embodiments, as the surface height deviation measuring means which measures the surface height deviation of surface, an optical film thickness meter which predicts the film thickness using a phase shift of a reflection light is used. The surface height deviation measuring means which measures the surface height deviation of surface may be any one of a tracing method, an optical measuring method, an electric resistance measuring method and a scanning electron microscope or a combination of them.

[Embodiment 9]

Figure 9:
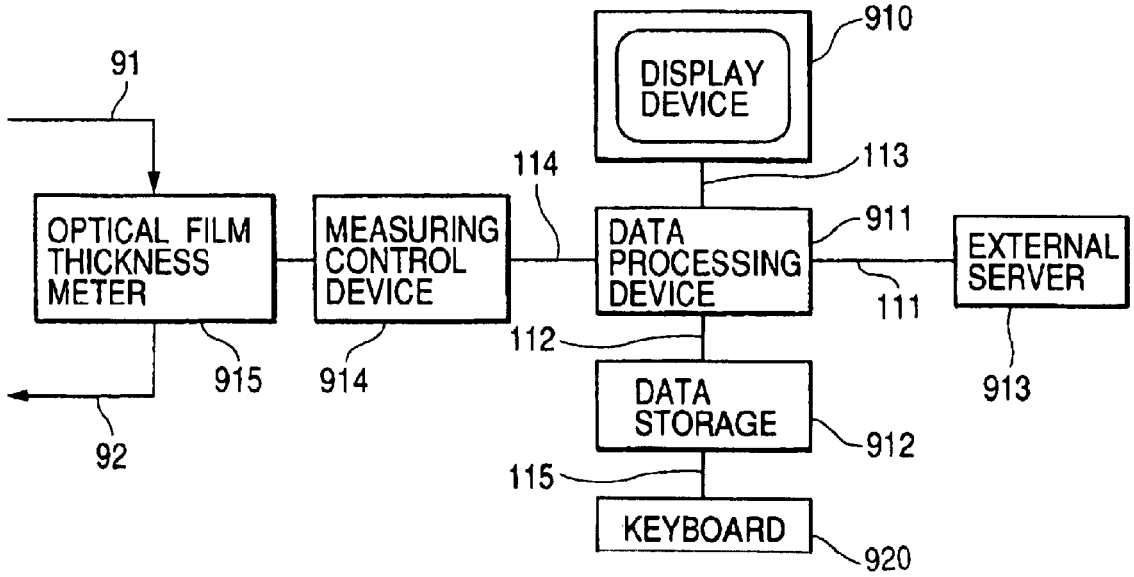
FIG. 9 is a block diagram showing the constitution of an inspecting device of a surface of a semiconductor device according to the present invention.

FIG. 9 is a block diagram showing the constitution of a device for inspecting a surface of a semiconductor device according to the present invention.

The device for inspecting a surface of a semiconductor device is constituted of a product loading system 91, a product unloading system 92, an optical film thickness meter 915, a measuring control device 914, a data processing device 911, a data storage 912, a display device 910, an external server 913, a keyboard 920 and signal lines 111 to 115 which connect these elements to each other.

The data storage 912 incorporates software which executes the the simulation and another software which compares the result of the simulation and the result of the measurement therein.

The manner of operation of the device for inspecting the surface of the semiconductor device is explained in conjunction with FIG. 1 and FIG. 9.

The external server 913 transmits mask data of a GDSII format related to a product to be polished to the data processing system 911 when necessary.

The data processing system 911 temporarily stores the mask data in the data storage 912 and, thereafter, starts the first simulation.

Although data such as parameter initial values, the film thickness and the like which are necessary in the simulation may be supplied from the keyboard 920, usually, it is desirable to transmit the data along with the mask data of a GDSII format.

By performing the first simulation, the rough surface height deviation distribution, the coordinates of the maximum surface height deviation and the coordinates of the minimum surface height deviation (r max, r min) can be obtained. Here, since the measurement is executed only at the point of r max and the point of r min, the coordinates of these two points are transmitted to the measuring control device 914.

The measuring control device 914 stores the transmitted coordinates values of r max and r min temporarily and, thereafter, instructs the optical film thickness meter 915 to execute the measurement at the coordinates of r max and r min sequentially.

In the optical film thickness meter 915, a polished product which constitutes an object to be measured is loaded and set by the product loading system 91.

The optical film thickness meter 915 transmits the measured surface height deviation values at the coordinates r max, r min to the measuring control device 914.

As soon as the measurement is completed, the product is unloaded by the product unloading system 92.

The measuring control device 914 transmits the result of the measurement to the data processing system 911.

The data processing system 911 compares the simulated surface height deviation Hj and the measured surface height deviation Hej and optimizes the parameters Rc, K, G, d or $1/\tau$ by performing the manipulations described in conjunction with the embodiment 1.

Upon completion of the optimization, the surface height deviations after polishing over the whole region of the product are calculated and are stored in the data storage 912.

When necessary, the surface height deviation after polishing is transmitted to the external server 913.

According to this embodiment 9, by measuring only extremely partial regions of the semiconductor product using the surface measuring device, it is possible to grasp the surface height deviation distribution after polishing of the whole region of the product.

Accordingly, it is possible to drastically reduce the time for inspecting the surface of the semiconductor device while maintaining the inspection accuracy.

According to the present invention, exposure mask data for the semiconductor device is divided into arbitrary regions, in an arbitrary region j of the exposure mask data, $\rho j = Pj/Sj$ which is the ratio between an area Sj of the region j and the area Pj of a portion in the region j where a pattern is present is calculated. The surface height deviation Hj of the semiconductor device after chemical mechanical polishing is obtained by the simulation which is performed using, as parameters, the ratio ρj, the size of the step h on the surface of the semiconductor device before polishing, the polishing speed K of the chemical mechanical polishing device, Young's modulus G of the polishing pad, the half-value width Rc of the stress function and the thickness d of the polishing pad. The surface height deviations Hej are measured at at least two divided regions. The surface height deviation Hj after the chemical and mechanical polishing and the measured surface height deviation Hej are compared with each other. Values of the polishing speed K, the Young's modulus G and the half-value width Rc are changed until the surface height deviation Hj after chemical and mechanical polishing agrees with the measured surface height deviations Hej at least in portions of the regions. The surface height deviation after polishing is simulated using values of the polishing speed K, the Young's modulus G, the half-value width Rc and the thickness d which are newly obtained by the change and the surface height deviations of regions where the above-mentioned measured surface height deviations Hej are not present can be determined. According to this invention, it is possible to know the surface height deviation distribution of the whole region of a semiconductor chip or a semiconductor wafer by measuring only extremely partial regions of the semiconductor chip or the semiconductor wafer and hence, the measuring time can be largely reduced.

The lowest point and the highest point in an surface height deviation after the chemical and mechanical polishing can be calculated before performing the measurement, and the lowest point and the highest point in a surface height deviation can be selected as regions which constitute the objects to be measured of the surface height deviation Hej. In this case, the range of the surface height deviation distribution on the chip or the wafer can be obtained with an improved accuracy.

By including exposure mask data of at least one layer which is present below the layer to be polished in the exposure mask data, the prediction of the surface height deviation distribution can be made while taking the influence of irregularities of the lower layer into consideration and hence, the high surface height deviation prediction accuracy is ensured even in case of a multi-layered film.

What is claimed is:

1. A method for inspecting a surface of a semiconductor device being characterized in that exposure mask data for a semiconductor device is divided into arbitrary regions, in an arbitrary region j of the exposure mask data, $\rho j = Pj/Sj$ which is a ratio between an area Sj of the region j and an area Pj of a portion in the region j where a pattern is present is calculated, a surface height deviation Hj of the semiconductor device after chemical mechanical polishing is obtained by a simulation which is performed using, as parameters, the ratio ρj, a size h of a step on a surface of the semiconductor device before polishing, a polishing speed K of a chemical mechanical polishing device, Young's modulus G of a polishing pad, a half-value width Rc of a stress function and a thickness d of the polishing pad, surface height deviations Hej are measured at at least two divided regions, the surface height deviation Hj after the chemical and mechanical polishing and the measured surface height deviations Hej are compared with each other, values of the polishing speed K, the Young's modulus G and the half-value width Rc are changed until the surface height deviation Hj after chemical and mechanical polishing agrees with the measured surface height deviations Hej at least in portions of the regions, and surface height deviations after polishing are simulated using values of the polishing speed K, the Young's modulus G, the half-value width Rc and the thickness d which are newly obtained by the change and surface height deviations of regions where the measured surface height deviations Hej are not present are determined.

2. A method for inspecting a surface of a semiconductor device according to claim 1, wherein when an object to be polished is a silicon oxide film or a silicon oxide film containing at least one kind selected from a group consisting of hydrogen, carbon, phosphorus and fluorine, a value of 0.5 mm to 2.0 mm is used as a value of the half-value width Rc of the stress function, and as a value $K \times G/(P \times d)$ which is obtained by dividing a value of $K \times G$ with a pressure P with which the polishing pad comes into contact with the surface of the semiconductor device and a thickness d of the polishing pad, a value which falls in a range from 0.016 to 0.05 is used.

3. A method for inspecting a surface of a semiconductor device according to claim 1, wherein the values of the polishing speed K, the Young's modulus G and the half-value width Rc which minimize an error evaluation function $\Sigma j(Hj-Hej)^2$ are obtained by a least square method, and a surface height deviation after the chemical mechanical polishing at an arbitrary point on a semiconductor chip or a wafer is obtained based on the value of the thickness d and the values of the polishing speed K, the Young's modulus G and the half-value width Rc which are obtained by the least square method.

4. A method for inspecting a surface of a semiconductor device according to claim 1, wherein a lowest point and a highest point in a surface height deviation after the chemical and mechanical polishing are calculated before performing the measurement, and the lowest point and the highest point in a surface height deviation are selected as regions which constitute the objects to be measured of the a surface height deviation Hej.

5. A method for inspecting a surface of a semiconductor device according to claim 1, wherein the exposure mask data includes exposure mask data of at least one layer which is present below a layer which constitutes an object to be polished.

6. A method for inspecting a surface of a semiconductor device according to claim 1, wherein the divided regions are each of 0.5 μm to 250 μm square.

7. A method for inspecting a surface of a semiconductor device according to claim 1, wherein a film which constitutes an object to be polished is an ozone-TEOS (Tetraethylorthosilicate) film, a plasma TEOS film, a high-density plasma CVD film, a spin coat insulation film, a silicon nitride film, a plated Cu film, a tungsten film, a tantalum film, a ruthenium film, a titanium nitride film or a combination of these films.

8. A method for inspecting a surface of a semiconductor device according to claim 1, wherein the surface height deviation measuring method is any one of a tracing method, an optical measuring method, an electric resistance measuring method and a scanning electron microscope or a combination of these methods.

9. A device for inspecting a surface of a semiconductor device comprising:

means which divides exposure mask data for a semiconductor device into arbitrary regions and calculates, in an arbitrary region j of the exposure mask data, $\rho j = Pj/Sj$ which is a ratio between an area Sj of the region j and an area Pj of a portion in the region j where a pattern is present, means which obtains an surface height deviation Hj of the semiconductor device after chemical mechanical polishing by a simulation which is performed using, as parameters, the ratio $\rho j$, a size h of a step on a surface of the semiconductor device before polishing, a polishing speed K of a chemical mechanical polishing device, Young's modulus G of a polishing pad, a half-value width Rc of a stress function and a thickness d of the polishing pad, means which measures surface height deviations Hej at at least two divided regions, means which compares the surface height deviation Hj after the chemical mechanical polishing and the measured surface height deviations Hej each other, means which changes values of the polishing speed K, the Young's modulus G and the half-value width Rc until the surface height deviation Hj after chemical mechanical polishing agrees with the measured surface height deviations Hej at least in portion of the regions, and means which simulates surface height deviation after polishing using values of the polishing speed K, the Young's modulus G, the half-value width Rc and the thickness d which are newly obtained by the change and determines surface height deviations of regions where the measured surface height deviations Hej are not present.

10. A device for inspecting a surface of a semiconductor device according to claim 9, wherein the surface height deviation measuring means is surface height deviation measuring means including at least one of a tracing method, an optical measuring method, an electric resistance measuring method and a scanning electron microscope.

11. A method for inspecting a surface of a semiconductor device according to claim 2, wherein the values of the polishing speed K, the Young's modulus G and the half-value width Rc which minimize an error evaluation function $\Sigma j(Hj-Hej)^2$ are obtained by a least square method, and a surface height deviation after the chemical mechanical polishing at an arbitrary point on a semiconductor chip or a wafer is obtained based on the value of the thickness d and the values of the polishing speed K, the Young's modulus G and the half-value width Rc which are obtained by the least square method.

12. A method for inspecting a surface of a semiconductor device according to claim 2, wherein a lowest point and a highest point in a surface height deviation after the chemical and mechanical polishing are calculated before performing the measurement, and the lowest point and the highest point in a surface height deviation are selected as regions which constitute the objects to be measured of the a surface height deviation Hej.

13. A method for inspecting a surface of a semiconductor device according to claim 2, wherein the exposure mask data includes exposure mask data of at least one layer which is present below a layer which constitutes an object to be polished.

14. A method for inspecting a surface of a semiconductor device according to claim 2, wherein the divided regions are each of 0.5 $\mu$m to 250 $\mu$m square.

15. A method for inspecting a surface of a semiconductor device according to claim 2, wherein a film which constitutes an object to be polished is an ozone-TEOS (Tetraethylorthosilicate) film, a plasma TEOS film, a high-density plasma CVD film, a spin coat insulation film, a silicon nitride film, a plated Cu film, a tungsten film, a tantalum film, a ruthenium film, a titanium nitride film or a combination of these films.

16. A method for inspecting a surface of a semiconductor device according to claim 2, wherein the surface height deviation measuring method is any one of a tracing method, an optical measuring method, an electric resistance measuring method and a scanning electron microscope or a combination of these methods.

17. A method for inspecting a surface of a semiconductor device according to claim 3, wherein a lowest point and a highest point in surface height deviation after the chemical and mechanical polishing are calculated before performing the measurement, and the lowest point and the highest point in surface height deviation are selected as regions which constitute the objects to be measured of the surface height deviation Hej.

18. A method for inspecting a surface of a semiconductor device according to claim 3, wherein the exposure mask data includes exposure mask data of at least one layer which is present below a layer which constitutes an object to be polished.

19. A method for inspecting a surface of a semiconductor device according to claim 3, wherein the divided regions are each of 0.5 $\mu$m to 250 $\mu$m square.

20. A method for inspecting a surface of a semiconductor device according to claim 3, wherein a film which constitutes an object to be polished is an ozone-TEOS (Tetraethylorthosilicate) film, a plasma TEOS film, a high-density plasma CVD film, a spin coat insulation film, a silicon nitride film, a plated Cu film, a tungsten film, a tantalum film, a ruthenium film, a titanium nitride film or a combination of these films.

* * * * *